US007416616B2

(12) United States Patent
Sano et al.

(10) Patent No.: US 7,416,616 B2
(45) Date of Patent: Aug. 26, 2008

(54) NON-HEAT TREATED STEEL FOR SOFT-NITRIDING

(75) Inventors: Naoyuki Sano, Takarazuka (JP); Takayuki Nakatani, Kobe (JP); Yoshihiko Kamada, Ashiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/312,498

(22) Filed: Dec. 21, 2005

(65) Prior Publication Data

US 2006/0096671 A1 May 11, 2006

Related U.S. Application Data

(63) Continuation of application No. PCT/JP2004/012372, filed on Aug. 27, 2004.

(30) Foreign Application Priority Data

Sep. 1, 2003 (JP) ..... 2003-308877

(51) Int. Cl.
*C22C 38/22* (2006.01)
*C22C 38/04* (2006.01)
*C22C 38/14* (2006.01)

(52) U.S. Cl. ..... 148/320; 148/330; 148/332; 148/336

(58) Field of Classification Search ..... 148/320, 148/318, 330, 332, 336; 420/126, 128, 121, 420/123

See application file for complete search history.

(56) References Cited

U.S. PATENT DOCUMENTS 6,391,124 B1 * 5/2002 Matsumoto et al. ..... 148/318
6,660,105 B1 * 12/2003 Ochi et al. ..... 148/320

FOREIGN PATENT DOCUMENTS

| | | | |
|---|---|---|---|
| JP | 403177537 | * | 8/1991 |
| JP | 05-065592 | | 3/1993 |
| JP | 405279794 | * | 10/1993 |
| JP | 407034189 | * | 2/1995 |
| JP | 07-157842 | | 6/1995 |
| JP | 08-176733 | | 7/1996 |

(Continued)

OTHER PUBLICATIONS

Computer-generated English translation of Japanese patent 408176733 dated Jul. 9, 1996, Izumi, Koji et al.*

*Primary Examiner*—Deborah Yee
(74) *Attorney, Agent, or Firm*—Clark & Brody

(57) ABSTRACT

Non-heat treated steel for soft-nitriding to form parts having high fatigue strength and excellent bend leveling property even in a case of applying soft-nitriding without thermal refining, comprising, by mass %, C: 0.30 to 0.45%, Si: 0.1 to 0.5%, Mn: 0.6 to 1.0%, Ti: 0.005-0.1% and N: 0.015 to 0.030%, and the balance Fe and impurities, having a mixed microstructure of bainite and ferrite whose bainite fraction is 5 to 90% or having a mixed microstructure of bainite, ferrite and pearlite whose bainite fraction is 5 to 90%, the steel could contain one or more of elements of Nb: 0.003 to 0.1% Mo: 0.01 to 1.0%, Cu: 0.01-1.0%, Ni: 0.01 to 1.0%, B: 0.001 to 0.005%, S: 0.01 to 0.1%, and Ca: 0.0001 to 0.005.

4 Claims, 2 Drawing Sheets

FOREIGN PATENT DOCUMENTS

| | | | |
|---|---|---|---|
| JP | 408176733 | * | 7/1996 |
| JP | 09-291339 | | 11/1997 |
| JP | 09-324241 | | 12/1997 |
| JP | 09-324258 | | 12/1997 |
| JP | 10-046287 | | 2/1998 |
| JP | 11-062943 | | 3/1999 |
| JP | 411062943 | * | 3/1999 |
| JP | 2979987 | | 11/1999 |
| JP | 2000-008141 | | 1/2000 |
| JP | 2000-160287 | | 6/2000 |
| JP | 2000-309846 | | 11/2000 |
| JP | 2001-254143 | | 9/2001 |
| JP | 3267164 | | 3/2002 |
| JP | 3297500 | | 7/2002 |
| JP | 2003-147478 | | 5/2003 |

* cited by examiner

NON-HEAT TREATED STEEL FOR SOFT-NITRIDING

This application is a continuation of International Patent Application No. PCT/JP2004/012372, filed Aug. 27, 2004. This PCT application was not in English as published under POT Article 21(2).

BACKGROUND OF THE INVENTION

1. Field of the Invention

The present invention relates to a non-heat treated steel for soft-nitriding. More specifically, it relates to a non-heat treated steel for soft-nitriding as materials of machine parts such as crankshafts or connecting rods, for example, in automobiles, industrial machines and construction machines.

2. Description of the Related Art

Heretofore, machine parts such as crankshafts or connecting rods, for example, in automobiles, industrial machines and the construction machines are manufactured by applying hot working such as hot forging and then applying thermal refining (hardening, tempering, normalizing, or annealing). The microstructure is homogenized and refined by the thermal refining. After the thermal refining, soft-nitriding is applied with an aim of improving the fatigue strength.

Since distortion occurs upon application of the soft-nitriding and deteriorates the dimensional accuracy of parts, bend leveling, or straightening, is often conducted after applying the soft-nitriding. Accordingly, it is necessary for parts after the soft-nitriding to have high fatigue strength and excellent bend leveling property.

"Excellent bend leveling property" means that cracks are not developed on the surface of the part till reaching a certain large bending displacement amount and that the fatigue strength after applying the bend leveling does not reduce so much as that before applying the bend leveling.

In the manufacture of machine parts, omission of thermal refining is desired for decreasing the manufacturing cost and saving the energy. Such demands have become strong more and more in recent years.

However, in a case where the thermal refining is omitted, non-homogeneous microstructure formed during hot working tends to remain and, further, crystal grains that are grown coarse during heating of the material before starting hot working remain in the products, which lowers the mechanical property of products. Then, normalization treatment is usually applied after hot working to solve the problem. In a case of not applying the normalization treatment after hot working, the crystal grains remain coarse, and a non-homogeneous microstructure is formed in which hot deformed structure remains partially. Accordingly, no desired fatigue strength can be obtained for the material without normalization treatment even when the soft-nitriding is applied.

Further, as described above, it is necessary for parts after soft-nitriding to have excellent bend leveling property but, in a case of omitting the thermal refining, the bend leveling property of parts after soft-nitriding is often deteriorated remarkably because of coarse crystal grain and/or non-homogeneous microstructure described above.

Accordingly, it has been demanded for the development of parts having high fatigue strength and excellent bend leveling property even in a case of omitting a thermal refining with an aim of cost reduction and energy saving, as well as a non-heat treated steel for use in soft-nitriding capable of obtaining such parts.

Then, "normalization" is to be described as a typical example of thermal refining. As the method of obtaining non-heat treated steel for soft-nitriding capable of forming parts having high fatigue strength and excellent "bend leveling property" after soft-nitriding even in a case of omitting the normalization treatment, several methods have been proposed so far. They are classified roughly into the following groups.

(1) A method of avoiding growth of the microstructure in hot forging as much as possible while keeping the microstructure of a steel to consist of ferrite and pearlite such as in thermally refined steels (for example, refer to the following Patent Documents 1 to 4).

(2) A method of forming the microstructure of steel into bainite (for example, refer to the following Patent Documents 5 to 9).

[Patent Document 1] Japanese Patent Unexamined Publication No. H9-291339.

[Patent Document 2] Japanese Patent Unexamined Publication No. H9-324258.

[Patent Document 3] Japanese Patent Unexamined Publication No. H9-324241.

[Patent Document 4] Japanese Patent Unexamined Publication No. H10-46287.

[Patent Document 5] Japanese Patent Unexamined Publication No. H5-65592.

[Patent Document 6] Japanese Patent Unexamined Publication No. 2000-309846.

[Patent Document 7] Japanese Patent Unexamined Publication No. H7-157842.

[Patent Document 8] Japanese Patent Unexamined Publication No. H8-176733.

[Patent Document 9] Japanese Patent Unexamined Publication No. 2000-160287.

The Patent Document 1 discloses a steel for nitriding in which the content of alloying elements comprises, by mass %, C: 0.15 to 0.40%, Si: ≦0.50%, Mn: 0.20 to 1.50%, Cr: 0.05 to 0.50%, and the balance Fe and inevitable impurities, in which the microstructure after hot working is substantially a ferrite—pearlite microstructure, the ferrite area fraction is 30% or more, the ferrite grain size is of 5 or more of grain size number, and the average size of pearlite is 50 μm or less. It is described that the steel is excellent in the fatigue strength and the bend leveling property after the nitriding even when normalization treatment is omitted.

The Patent Document 2 discloses nitrided parts formed by nitriding a steel in which the steel contains alloying elements comprising, by mass %, C: 0.15 to 0.40%, Si: 0.50% or less, Mn: 0.20 to 1.50%, and Cr: 0.05 to 0.50%, and the balance Fe and inevitable impurities, in which the steel has a mixed microstructure comprising ferrite and pearlite in a state as hot worked, the average size of ferrite grains is 50 μm or less, the average size of pearlite grains is 50 μm or less, the average hardening depth by the nitriding is 0.3 mm or more and the fluctuation of the hardening depth is within a range of 0.1 mm. Then, it is described that the part is excellent in the fatigue strength and the bend leveling property even in a case of nitriding while omitting the normalization treatment after hot forging.

The Patent Document 3 discloses a steel material for soft-nitriding having a chemical composition comprising, by weight %, C: 0.20 to 0.60%, Si: 0.05 to 1.0%, Mn: 0.3 to 1.0%, P: 0.05% or less, S: 0.005 to 0.10%, Cr: 0.3% or less, Al: 0.08% or less, Ti: 0.03% or less, N: 0.008 to 0.020%, Ca: 0.005% or less, Pb: 0.30% or less, Cu: 0.30% or less, Ni: 0.30% or less, Mo: 0.30% or less, V: 0.20% or less, Nb: 0.05% or less, and satisfying: $221C(\%)+99.5Mn(\%)+52.5Cr(\%)-304Ti(\%)+577N(\%)+25 \geqq 150$, with the balance Fe and inevitable impurities, in which the microstructure comprises ferrite and pearlite with the ferrite fraction of 10% or more, etc.

The Patent Document 3 describes that nitrided parts excellent in the fatigue strength and the bend leveling property can be obtained even when the normalization treatment is omitted in a case where the fatigue strength is expressed as the regression formulae of the contained elements and the factor is at a predetermined magnitude or more, and the microstructure comprises ferrite and pearlite with the ferrite fraction of 10% or more.

The Patent Document 4 discloses a steel for nitriding comprising, by weight %, C: 0.30 to 0.43%, Si: 0.05 to 0.40%, Mn: 0.20 to 0.60%, P: 0.08% or less, S: 0.10% or less, sol. Al: 0.010% or less, Ti: 0.013% or less, Ca: 0.0030% or less, Pb: 0.20% or less, and N: 0.010 to 0.030%, and the balance Fe and impurities, in which Cr is 0.10% or less and V is 0.01% or less in the impurities, etc.

The Patent Document 4 describes that a product excellent in the fatigue strength and the bend leveling property can be obtained by moderating the hardness gradient in a nitriding layer even when applying nitriding while omitting the normalization treatment.

The Patent Document 5 discloses a steel with high fatigue strength comprising, C: 0.1 to 0.35%, Si: 0.05 to 0.35%, Mn: 0.6 to 1.50%, P: 0.01% or less, S: 0.015% or less, Cr: 1.1 to 2.0%, Mo: 0.5 to 1.0%, V: 0.03 to 0.13%, B: 0.0005 to 0.0030%, Ti: 0.01 to 0.04%, Al: 0.01 to 0.04%, and the balance Fe and inevitable impurities, etc.

The Patent Document 5 describes that Cr is effective for improving the hardenability and nitriding hardenability and V is effective for refining precipitated carbides to enhance the fatigue strength. In this case, since the nitriding hardenability caused by Cr is due to precipitation of Cr nitrides, improvement in the fatigue strength in this case is based on precipitation hardening by Cr and V. However, in the Patent Document, a once produced steel material is again heated and cooled to form a bainite microstructure, then the steel is classified into the category of thermally refined steel.

The Patent Document 6 discloses a non-heat treated steel for soft-nitriding containing, by mass %, C: not less than 0.1% but less than 0.3%, Si: 0.01 to 1.0%, Mn: 1.5 to 3.0%, Cr: 0.01 to 0.5%, Mo: 0.1 to 1.0%, acid soluble Al: 0.01 to 0.045%, N: 0.005 to 0.025%, and the balance Fe and inevitable impurities, etc.

The Patent Document 6 describes that the steel having the bainite structure obtained by air cooling from the hot working temperature is excellent in toughness and has excellent bend leveling property after applying soft-nitriding. In this case, the C content is defined as less than 0.3% in order that the hardness of bainite does not become excessive to deteriorate the machinability, and the Mn content is defined as 1.5% or more for ensuring the hardenability of the steel to form bainite. Further, the hardness of the nitrided layer is intended to be increased by precipitation hardening due to Cr nitrides by the addition of 0.01 to 0.05% of Cr. That is, in the Patent Document, the C content is defined as less than 0.3% so that the hardness of bainite is not excessively high, on the bases of the fact that the bend leveling property is improved by the bainite microstructure because bainite has higher toughness than the ferrite-pearlite microstructure at an identical hardness. However, a steel where the C content is less than 0.3% is worried about the lack of wear resistance. In machine parts such as crankshafts and connecting rods, the wear resistance is also an extremely important factor.

The Patent Document 7 discloses a steel for soft-nitriding having a chemical composition comprising, by weight %, C: 0.05 to 0.30%, Si: 1.20% or less, Mn: 0.60 to 1.30%, Cr: 0.70 to 1.50%, Al: 0.10% or less, N: 0.006 to 0.020%, V: 0.05 to 0.20%, Mo: 0 to 1.00%, B: 0 to 0.0050%, S: 0 to 0.060%, Pb: 0 to 0.20%, Ca: 0 to 0.010%, satisfying $0.60 \leqq C+0.1Si+0.2Mn+0.25Cr+1.65V \leqq 1.35$, or satisfying $0.60 \leqq C+0.1Si+0.2Mn+0.25Cr+1.65V+0.55Mo+8B \leqq 1.35$, and the balance Fe and inevitable impurities, with the hardness of a core part of Hv 200 to 300 and the microstructure being a bainite or having a mixed microstructure of "ferrite+bainite" where ferrite fraction is less than 80%, by cooling after hot rolling or hot forging with no heat treatment.

The invention in the Patent Document 7 also adopts the idea of improving the fatigue strength by utilizing the precipitation hardening caused by Cr and V as well as in Japanese Patent Unexamined Publication No. H5-65592 described above. However, since the C content is defined as less than 0.3%, the worry about the lack of the wear resistance remains as well as in Japanese Patent Unexamined Publication No. 2000-309846 described above.

The Patent Document 8 discloses a steel for soft-nitriding comprising, by weight %, C: 0.15 to 0.40%, Si: 1.20% or less, Mn: 0.60 to 1.80%, Cr: 0.20 to 2.00%, Al: 0.02 to 0.10%, N: 0.006 to 0.020%, V: 0.05 to 0.20%, and the balance Fe and inevitable impurities, and satisfying both conditions of $0.60 \leqq C+0.1Si+0.2Mn+0.25Cr+1.65V \leqq 1.35$ and $0.25Cr+2V \leqq 0.85$, with the hardness for a core part of Hv 200 to 300, and having mixed microstructure of "ferrite+pearlite" or a mixed microstructure of "ferrite+pearlite+bainite whose bainite fraction is less than 20%", by cooling after hot rolling or hot forging without heat treatment, and discloses a steel that has high surface hardness and deep hardened depth and, further, low heat treatment distortion by applying soft-nitriding.

It is expected that the disclosed steel in the Patent Document 8 is improved for the wear resistance since the C content is 0.15 to 0.40%. However, the idea of improving the fatigue strength by utilizing the precipitation hardening caused by Cr and V is also adopted in this steel as well as in the invention of Japanese Patent Unexamined Publication No. H7-157842 described above.

The Patent Document 9 discloses a non-heat treated forged nitrided parts containing, C: 0.15 to 0.35%, Mn: 1.00 to 3.00%, Cr: 0 to 0.15%, V: 0 to 0.02%, Cu: 0.50 to 1.50%, and Ni: 0.4 times or more of the Cu content, with B, N and Ti contents satisfying 0.0010 to 0.0030% of Bsol as defined by $Bsol=B-(11/14)\{N-(14/48)\ Ti\}$, with the balance Fe and inevitable impurity.

The Patent Document 9 describes as follows:

It is preferred that the steel for soft-nitriding comprises a ferrite-based microstructure or, in a case where it is difficult, a single phase microstructure of martensite or bainite rather than a mixed microstructure of "ferrite+pearlite". This adopts an idea of utilizing precipitation hardening caused by Cu instead of by Cr and V. Further, it is described that Mn content has to be 1.0% or more in order to obtain the fully bainitic microstructure, which means to intend to a non-heat treated steel with fully bainitic microstructure.

As has been described above, it has been already known to obtain a non-heat treated steel utilizing the bainite microstructure for soft-nitriding, which provides parts excellent in the fatigue strength and the bend leveling property after soft-nitriding. However, improvement of the fatigue strength by the precipitation hardening caused by the alloying additions deteriorates the bend leveling property on the other hand. That is, the subject of compatibilizing the high fatigue strength and the excellent bend leveling property has not yet been solved.

Further, in order to cope with the demand of further increasing the strength of parts in recent years, it has been demanded for a non-heat treated steel for soft-nitriding, which provides soft-nitrided parts that have higher fatigue strength and are excellent in the bend leveling property. However, the existent technique of "precipitation hardening and bainitic microstructure" cannot always cope with such a demand.

SUMMARY OF THE INVENTION

The objective of the present invention is to provide a non-heat treated steel for soft-nitriding, which is capable of providing parts that, even in a case of applying the soft-nitriding without thermal refining, have a fatigue strength and a bend leveling property equivalent to the case of applying soft-nitriding to a thermally refined steel.

The following (1) and (2) are a non-heat treated steel for soft-nitriding according to the present invention.

(1) A non-heat treated steel for soft-nitriding characterized by consisting of, by mass %, C: 0.30 to 0.45%, Si: 0.1 to 0.5%, Mn: 0.6 to 1.0%, Ti: 0.005 to 0.1%, N: 0.015 to 0.030%, and the balance Fe and impurities, and also characterized by having a mixed microstructure of bainite and ferrite whose bainite fraction is 5 to 90% or having a mixed microstructure of bainite, ferrite and pearlite whose bainite fraction is 5 to 90%.

(2) A non-heat treated steel for soft-nitriding characterized by consisting of, in addition to the element described in (1) above, one or more elements selected from the first element group and/or one or two elements selected from the second element group, and the balance Fe and impurities, and also characterized by having a mixed microstructure of bainite and ferrite whose bainite fraction is 5 to 90% or having a mixed microstructure of bainite, ferrite and pearlite whose bainite fraction is 5 to 90%.

The elements belonging to the first group:
Nb: 0.003 to 0.1%,
Mo: 0.01 to 1.0%,
Cu: 0.01 to 1.0%,
Ni: 0.01 to 1.0% and
B: 0.001 to 0.005%.

The elements in the second group:
S: 0.01 to 0.1% and
Ca: 0.0001 to 0.005%.

In order to solve the foregoing problems, the present inventors prepared various non-heat treated steels for soft-nitriding and studied on the fatigue strength and the bend leveling property after soft-nitriding. Then, they studied on the correlation between those properties and the microstructures of the steel before soft-nitriding. Further, they also made a detailed study on the development of the microstructure by the soft-nitriding and studied the effect of the microstructure of steel after the soft-nitriding on the fatigue strength and the bend leveling property. As the result, the following findings were obtained.

(a) In order to manufacture a steel excellent in both of fatigue strength and bend leveling property in a case where they are soft-nitrided even when normalization and other thermal refining are omitted, a combination of the structure refining and appropriate strengthening that does not excessively strengthen the ferrite grain is effective.

(b) Precipitation hardening caused by Cr and/or V is unnecessary. Addition of such elements is rather deleterious and they are desirably kept to an actual impurity level in the steel manufacturing process.

Specifically, it is intended for refining the microstructure to suppress the coarsening of crystal grains during hot working and to form bainite-containing mixed microstructure. Then, solid solution strengthening in the ferrite and precipitation hardening caused by iron nitrides, which are formed upon soft-nitriding, are utilized. They can provide parts after soft-nitriding with excellent fatigue strength and bend leveling property.

The findings obtained by the present inventors are to be described more specifically.

FIG. 1 shows a photograph for typical microstructure of "bainite+ferrite+pearlite". "Bainite" means a mixed microstructure of "ferrite+cementite", which is different from orderly lamellar pearlite and also different from martensite or retained austenite.

As shown in FIG. 1, the bainite structure is characterized by dispersion of ferrite in the form of bamboo leaves (referred to as "bainitic ferrite"). The hardness of the bainite structure is lower than that of coarse pearlite colony, since the cementite is dispersed relatively at random in the bainite structure. Further, the bainite structure has a relatively high resistance to crack propagation, since the ferrite and cementite boundaries are not so orderly arranged as in the pearlite structure. That is, while the bainite structure has more coarse structure than the fine pearlite colony assembly, it is excellent over the coarse pearlite colony in view of the balance between the strength and the toughness.

Further, the followings have been also found for N. That is, N is an element for stabilizing austenite, and reacts with Ti to form TiN. TiN precipitates by a certain amount even at 1100° C. or higher to form pinning particles that prevent austenite grain growth. Accordingly, by increasing the N content, a mixed microstructure of "bainite+ferrite" or "bainite+ferrite+pearlite" in which bainite is mixed properly can be formed while suppressing the coarsening of austenite grains. Even when the steel with this microstructure is applied with soft-nitriding even in a state not thermally refined, the fatigue strength is comparable with that in a case of soft-nitriding a steel that has a fine microstructure of "ferrite+pearlite" which is obtained by the thermal refining such as normalization.

Further, even when alloying elements such as Cr and V are not contained, the fatigue strength can be increased with iron nitrides formed during soft-nitriding.

The iron nitrides just below the compound layer on the surface of the soft-nitrided layer, that is, in the diffusion layer are formed by a great amount of N introducing from the atmosphere during soft-nitriding and it has been found that iron nitrides also tend to precipitate easily in the diffusion layer at the depth of about 300 μm from the surface when the nitrogen content of the base material is increased. "Diffusion layer" described herein is defined according to JIS G 0562 where diffusion of nitrogen and carbon are observed in a surface layer of soft nitrided parts except the compound layer.

Further, when the steel according to the present invention is soft nitrided and the hardness profile in the direction of the depth from the surface to the interior is compared with that of the conventional steels containing Cr and/or V, it has been found that the hardness in the vicinity of the outermost surface of the present invention is smaller than that of the conventional steels and the core hardness of the present invention is substantially identical to or rather higher than that of the conventional steels. This is considered that the precipitation hardening due to the iron nitrides is milder than that caused by Cr and/or V and, accordingly, reduction in the ductility of ferrite of the present invention is suppressed more than in the conventional steels. Accordingly, the bend leveling property is not deteriorated.

As described above, for compatibilizing high fatigue strength and bend leveling property after soft-nitriding even when the thermal refining such as normalization is omitted, important points are to suppress austenite grain coarsening during hot working by pinning particles, to provide hardenability so as to form appropriate amount of bainite, and to provide precipitation hardening to ferrite grains in the vicinity of the surface to such an extent as not giving excessive strengthening.

The present invention has been accomplished based on the findings described above.

By the use of the non-heat treated steel for soft-nitriding according to the present invention, it is possible to provide soft-nitrided steel parts of high strength excellent in the fatigue strength and the bend leveling property even when the thermal refining such as normalization after hot forging is omitted. Accordingly, this greatly contributes to the reduction of the manufacturing cost of parts.

DESCRIPTION OF THE PREFERRED EMBODIMENTS

The constituent factors of the present invention are to be described. "%" for the content of each element represents herein "by mass %".

(A) Chemical Composition

C: 0.30 to 0.45%

C is an essential element for obtaining a mixed microstructure of "bainite+ferrite" or "bainite+ferrite+pearlite". In order to stabilize the austenite and to ensure the wear resistance of a material, a content of 0.30% or more is necessary. On the other hand, if it exceeds 0.45%, the hardenability is excessively increased tending to cause formation of deleterious martensite. Accordingly, an appropriate range for the C content is from 0.30 to 0.45%.

Si: 0.1 to 0.5%

Si is added as an deoxidation agent in the steel manufacturing process and since it is also effective for solid solution strengthening of ferrite, a content of 0.1% or more is necessary. On the other hand, if the Si content exceeds 0.5%, this increases the hot deformation resistance or deteriorates the toughness and the machinability of the steel. Accordingly, an appropriate range for the Si content is from 0.1 to 0.5%.

Mn: 0.6 to 1.0%

Mn is added as the deoxidation agent, too, in the steel manufacturing process. Further, it is an essential element for stabilizing austenite to obtain a mixed microstructure of "bainite+ferrite" or a mixed microstructure of "bainite+ferrite+pearlite". Further, Mn reacts with S in the steel to form MnS and to provide an effect for the improvement of the machinability.

In the mixed microstructure described above, the bainite fraction has to be 5% or more. And, in order to ensure the hardenability to form such a fraction of bainite, the Mn content of 0.6% or more is necessary. On the other hand, when the Mn content exceeds 1.0%, the hardenability excessively increases tending to form deleterious martensite. Accordingly, an appropriate range for the Mn content is from 0.6 to 1.0%.

Ti: 0.005 to 0.1%

Ti is an essential element for forming pinning particles to suppress grain coarsening during hot working. The pinning particles include Ti nitrides, Ti carbides and Ti carbonitrides and a content of 0.005% or more is necessary in order to form pinning particles of a sufficient number density. On the other hand, in order not to completely consume N in the steel that contributes to the increase of the base material strength by forming iron nitrides, it is necessary to restrict the Ti content to 0.1% or less. With the reasons described above, the appropriate range for the Ti content is from 0.005 to 0.1% and, more preferably, from 0.01 to 0.05%.

N: 0.015 to 0.030

N is added for stabilizing austenite to obtain a mixed microstructure of "bainite+ferrite" or a mixed microstructure of "bainite+ferrite+pearlite", for providing pinning particles to suppress the grain coarsening, and for forming iron nitrides to contribute to moderate precipitation hardening or contributing to solid solution strengthening to increase the strength of the base material. Considering the portion consumed as pinning particles, a content of 0.015% or more is necessary. On the other hand, when N exceeds 0.030%, bubble defects are likely to form in an ingot to sometimes deteriorate the material. Accordingly, an appropriate range for the N content is from 0.015 to 0.030 and, more preferably, 0.015 to 0.025%.

One of non-heat treated steels for soft-nitriding of the present invention is a steel comprising the elements described above, as well as the balance Fe and impurities.

Another non-heat treated steel for soft-nitriding according to the present invention is a steel comprising, in addition to the elements described above, one or more elements selected from the first element group and/or one or two elements selected from the second element group and the balance Fe and impurities.

The elements belonging to the first group, that is, Nb, Mo, Cu, Ni, and B have a common effect of increasing the strength of the steel according to the present invention. The effect and the reasons for defining the content for each of them are as described below.

Nb: 0.003 to 0.1%

Nb is an element that can be utilized for forming pinning particles to suppress the grain coarsening during hot working. Further, it also has an effect of increasing the strength of the base material by precipitating as fine carbonitrides during cooling after the completion of hot working. In order to obtain such effect, a content of 0.003% or more is necessary. On the other hand, when the content exceeds 0.1%, the effect is saturated, and it forms coarse carbonitrides as solution residues during steel manufacturing to sometimes deteriorate the quality of steel pieces. Accordingly, in a case of adding Nb, the content is, preferably, from 0.003 to 0.1%, more preferably, 0.005 to 0.1% and, most preferably, 0.01 to 0.05%.

Mo: 0.01 to 1.0%

Mo is an element of increasing the hardenability of steel to contribute to the increase of the strength and is effective for the improvement of the toughness as well. When Mo is added, a mixed microstructure of "bainite+ferrite" or a mixed microstructure of "bainite+ferrite+pearlite" can be obtained easily. In order to obtain such effects, the content of 0.01% or more is necessary. On the other hand, when the Mo content exceeds 1.0%, since the hardenability increases, formation of martensite is promoted to deteriorate the bend leveling property and the toughness after the soft-nitriding. Accordingly, in a case of adding Mo, The content is, preferably, from 0.01 to 1.0% and, more preferably, from 0.05 to 0.6%.

Cu: 0.01 t0 1.0%, Ni: 0.01 to 1.0%

When Cu is added, an increase of the bainite fraction by austenite stabilization and an effects of solid solution strengthening are expected. Accordingly, Cu could contain 0.01% or more.

Cu and Ni have no effect of carbonitrides precipitation, but Cu can contribute to age hardening by precipitating in ferrite. However, in a case of replacing the aging treatment with usual temperature (about 580° C.) and treating time (about several hours) of soft-nitriding, it is necessary that the Cu content is 1.0% or more for causing sufficient Cu precipitation. However, it is not necessary to expect a particular age hardening effect of Cu upon soft-nitrided parts obtained by soft-nitriding the steel of the present invention. Further, since the melting point of Cu is as low as 1085° C., it remains for a long time as a liquid phase in the solidifying step of the steel making process and, accordingly, it segregates to grain boundaries to induce hot cracking. In order to remove the drawback, the upper limit for the Cu content is defined as 1.0% in the steel of the present invention. In a case of adding a great amount of Cu, it is desirable to add Ni in order to prevent such drawback.

Ni is also an austenite stabilizing element like Cu and since it has an effect of solid solution strengthening and ensuring a desired bainite fraction, it preferably contains 0.01% or more. On the other hand, even when it is contained in an amount exceeding 1.0%, since the effect is saturated and it merely increases the material cost, the upper limit is defined as 1.0%. In a case of using Ni in combination with Cu, it is desirable that Ni is contained by ½ or more of the Cu content in order to ensure the effect of preventing hot cracking.

B: 0.001 to 0.005%

B increases the hardenability of steel to promote formation of a mixed microstructure of "bainite+ferrite" or a mixed microstructure of "bainite+ferrite+pearlite". The effect distinctly develops at the content of 0.001% or more. On the other hand, when the B content exceeds 0.005%, the toughness of the steel is deteriorated. Accordingly, in a case of adding B, it is preferred to define the content as 0.001 to 0.005%.

The elements in the second group are S and Ca, and they improve the machinability of the steel according to the present invention. The reason for defining the respective contents is as shown below.

S: 0.01 to 0.1%, Ca: 0.0001 to 0.005% Both S and Ca are elements for improving the machinability of the steel material. Since the machinability is further improved by the addition, one or two of them can be added as occasion demands. However, since an excessive addition causes segregation defects in the steel piece or degrades the hot workability, it is appropriate that the range for the S content is from 0.01 to 0.1% and the range for the Ca content is from 0.0001 to 0.005%. A preferred lower limit of Ca is 0.001%.

Since other elements than those described above are impurities in the steel of the present invention, they are not added intentionally. However, in order not to incur an unnecessary increase of the cost in the steel manufacturing process, an allowable amount of impurities is to be described.

Since P segregates to grain boundaries to promote grain boundary brittle cracking, it is preferably defined as 0.05% or less.

Al is usually added during melting as a deoxidation agent. Al remains in the steel as alumina particles or reacts with N to form AlN. Since alumina is oxide inclusions of high hardness, it shortens the working life of a tool used in machining. AlN precipitates in the vicinity of the surface during soft-nitriding or promotes growing of the surface compound layer to remarkably increase the hardness of the surface layer to deteriorate the bend leveling property. Further, since AlN particles dissolve at the hot working temperature, the function as the pinning particles cannot be expected and it is scarcely useful for refining the grain structure. Accordingly, a lower Al content is preferred. However, since minimizing the lower limit for the Al content results in the restriction in the deoxidation step leading to an increase of the cost, it is preferably 0.05% or less that does not hinder the bend leveling property of the steel according to the present invention.

Cr and V are also not added in the steel according to the present invention. Since they are impurities, it is preferred that the content thereof is smaller. This is because Cr and V precipitate nitrides to remarkably increase the hardness in the layer in the vicinity of the surface to deteriorate the bend leveling property as already described. As long as considering that the effect of the present invention is not deteriorated and from the view point of the refining cost and the purity used in methods other than the blast furnace-converter furnace method, 0.15% of Cr and 0.02% of V are permitted as impurities. Cr is more preferably 0.1% or less.

(B) Microstructure

The microstructure of the steel according to the present invention is a mixture of "bainite and ferrite" or a mixture of "bainite, ferrite and pearlite". The bainite fraction in the mixed microstructure described above is from 5 to 90%.

As described above, by the utilization of bainite transformation, formation of martensite can be avoided and finer microstructure than coarse pearlite colony can be obtained. As shown in FIG. 1, the microstructure is characterized by dispersion of bainitic ferrite whose appearance resembles bamboo leaves. The bainitic ferrite is dispersed inside the former austenite grains and is smaller than the polygonal ferrite that develops from the former austenite grain boundaries. That is, bainite is "a microstructure which has a relatively fine ferrite with a form of bamboo leaves dispersed in the pearlite colony". However, a matrix in which the bainitic ferrite is dispersed, is not the ordinary pearlite colony having orderly lamellar structure.

FIG. 2 is a SEM image of former austenite grains where bainitic ferrite is dispersed. As apparent from the view, arrangement of cementite is not an orderly lamella microstructure but disturbance is observed here and there. While the strength of such microstructure tends to be lower than that of the microstructure where the former austenite grains entirely undergo pearlite transformation, it is more excellent than coarse pearlite colony in view of the resistance to crack propagation. The reason is as described below.

Since cracks propagate while getting off the hard pearlite, they tend to propagate along the boundary between the pearlite colonies or the boundary between the pearlite colony and the ferrite. While the ferrite is soft compared with the pearlite, but is highly ductile, propagating cracks plastically deform the ferrite when entering the inside of the ferrite grains thereby consuming the energy thereof. Accordingly, crack tip of the propagating cracks is blunted, and it requires more work, that is, external loads, for further propagation of the crack, thereby increasing the resistance to crack propagation and enhancing the fatigue strength.

The fine mixed microstructure of "ferrite+pearlite" obtained by the normalization is excellent because the pearlite is responsible for the entire strength and the finely dispersed ferrite often inhibits the propagation of cracks. On the other hand, in a case where the pearlite colony is large, cracks develop such that fracture proceeds in a brittle manner along the big pearlite colonies. As the pearlite colony is larger, the crack propagation rate is higher and cracks propagated large enough can no more be arrested by ferrite.

In a case of using a microstructure where the bainite microstructure is associated instead of the coarse pearlite colony, cracks, that reach the portion of the bainite microstructure, propagate as they are to the inside without being deflected, and the bainitic ferrite dispersed inside acts to hinder the propagation of the cracks. Further, since the bainitic ferrite is smaller than the ferrite grains or pearlite colonies when normalized, it provides more frequent resistance to the propagating cracks to contribute to the improvement of the toughness.

As described above, even when the grain structure is somewhat coarsened, the presence of the bainite microstructure is effective to keep the resistance to crack development high. For this purpose, it is necessary to incorporate bainite by 5% or more by the area ratio. The entire microstructure may be constituted with bainite but, in a microstructure where the bainite fraction exceeds 90%, occurrence of martensite is actually inevitable. Since martensite deteriorates the bend leveling property and also worsens the machinability, the mixture of martensite is not preferred. Accordingly, the bainite fraction in the mixed microstructure is defined as 5 to 90% in the present invention. A further preferred bainite fraction is from 10 to 80%. The microstructure other than the bainite in the steel according to the present invention is substantially ferrite or ferrite and pearlite.

(C) Manufacturing Method of Steel According to the Present Invention

The microstructure of the steel according to the present invention can be obtained, for example, by the method shown below.

The raw material having a specified range of chemical compositions for hot forging, which can be billets obtained by blooming ingots, billets formed by blooming a continuous cast material or bar rods formed by hot rolling them. The heating temperature for the hot forging material is 1100 to 1250° C. Cooling after hot forging, atmospheric cooling or forced air cooling using a blower is conducted. Further, it may be cooled, for example, rapidly down to about the eutectoid transformation temperature and cooled slowly for a range from 700 to 500° C., or cooled quickly to about 500 to 300° C. after hot forging and may be kept at the temperature to promote bainite transformation. The cooling rate may be determined by previously preparing a continuous cooling transformation diagram (CCT curve diagram), to know the range for cooling rates passing through the bainite transformation region and, thereby, controlling to the determined cooling rate range.

(D) Soft-nitriding Treatment

For the soft-nitriding, gas soft-nitriding, salt bath soft-nitriding (tufftriding), ion nitriding, etc can be used. In any of the methods, it is possible to homogeneously form a compound layer (nitrided layer) of about 20 μm thickness on the surface of a product and a diffusion layer just therebelow.

In order to obtain machine parts by the gas soft-nitriding, treatment may be conducted, for example, in an atmosphere formed by mixing RX gas and ammonia gas at 1:1 ratio at 580° C. for 1 to 2 hours.

EXAMPLE

The present invention is to be described more specifically by way of examples.

After vacuum melting 180 kg of steels of the chemical compositions shown in Table 1 in a vacuum melting furnace, steel pieces were heated to 1200° C., and hot forged such that the temperature of the steel material was not lower than 1000° C. during the forging to form round bars of 50 mm diameter. Cooling after the hot forging was conducted by atmospheric cooling to steel pieces except sample Nos. 16 and 26. To the contrary, forced air cooling after the hot forging was applied to steel pieces shown by sample Nos. 16 and 26 by using a blower. Test pieces for the plane bend fatigue test were sampled from the round bars.

The test piece had a cylindrical body of 44 mm diameter fabricated with a tapered neck (neck diameter; 20 mm). By fixing the head of the test piece and applying a load to the opposite end, a bend leveling for a predetermined strain amount could be provided to the neck. Further, the round bar was cut diametrically into cylindrical samples and the machinability test by using a drill was conducted.

[Table 1]

TABLE 1

| | Test | Chemical composition (mass %; balance Fe and Impurities) | | | | | | | | | | | | | | Bainite fraction |
|---|---|---|---|---|---|---|---|---|---|---|---|---|---|---|---|---|
| | No. | C | Si | Mn | Ti | N | Nb | Mo | Cu | Ni | S | Ca | B | Cr | V | (%) |
| Present invention | 1 | 0.38 | 0.15 | 0.80 | 0.010 | 0.020 | — | — | — | — | — | — | — | — | — | 7% |
| | 2 | 0.32 | 0.25 | 0.70 | 0.035 | 0.025 | — | — | — | — | — | — | — | — | — | 10% |
| | 3 | 0.44 | 0.16 | 0.65 | 0.025 | 0.016 | — | — | | — | — | — | — | — | — | 8% |
| | 4 | 0.38 | 0.17 | 0.81 | 0.015 | 0.021 | 0.030 | — | — | — | — | — | — | — | — | 15% |
| | 5 | 0.36 | 0.18 | 0.75 | 0.011 | 0.019 | — | 0.34 | — | — | — | — | — | — | — | 50% |
| | 6 | 0.35 | 0.14 | 0.79 | 0.011 | 0.018 | 0.011 | 0.22 | — | — | — | — | — | — | — | 42% |
| | 7 | 0.37 | 0.18 | 0.82 | 0.014 | 0.022 | — | — | 0.50 | — | — | — | — | — | — | 33% |
| | 8 | 0.35 | 0.20 | 0.78 | 0.017 | 0.024 | — | — | — | 0.52 | — | — | — | — | — | 20% |
| | 9 | 0.38 | 0.16 | 0.82 | 0.018 | 0.021 | — | — | 0.32 | 0.17 | — | — | — | — | — | 25% |
| | 10 | 0.37 | 0.40 | 0.88 | 0.051 | 0.029 | — | — | — | — | 0.062 | — | — | — | — | 13% |
| | 11 | 0.38 | 0.39 | 0.87 | 0.048 | 0.028 | — | — | — | — | — | 0.0020 | — | — | — | 14% |
| | 12 | 0.37 | 0.38 | 0.85 | 0.045 | 0.026 | — | — | — | — | 0.052 | 0.0018 | — | — | — | 13% |
| | 13 | 0.38 | 0.16 | 0.79 | 0.031 | 0.021 | — | — | — | — | — | — | 0.0022 | — | — | 26% |
| | 14 | 0.33 | 0.20 | 0.90 | 0.032 | 0.022 | 0.009 | 0.10 | 0.61 | 0.30 | — | — | — | — | — | 38% |
| | 15 | 0.40 | 0.16 | 0.85 | 0.009 | 0.019 | 0.015 | 0.60 | — | — | 0.048 | 0.0010 | — | — | — | 78% |
| | 16 | 0.38 | 0.16 | 0.85 | 0.022 | 0.028 | 0.010 | 0.25 | — | — | 0.052 | 0.0012 | 0.0031 | — | — | 65% |
| | 17 | 0.37 | 0.40 | 0.63 | 0.060 | 0.020 | 0.050 | 0.83 | 0.80 | 0.45 | 0.091 | 0.0015 | 0.0018 | — | — | 89% |
| | 18 | 0.36 | 0.16 | 0.81 | 0.012 | 0.019 | — | — | — | — | — | — | — | 0.14 | — | 30% |
| | 19 | 0.37 | 0.18 | 0.78 | 0.017 | 0.021 | — | — | — | — | — | — | — | — | 0.01 | 9% |
| | 20 | 0.38 | 0.21 | 0.80 | 0.011 | 0.018 | — | — | — | — | — | — | — | 0.10 | 0.015 | 25% |
| Comparative | 21 | 0.48 | 0.27 | 1.41 | 0.006 | 0.018 | — | — | — | — | 0.046 | — | — | 0.15 | 0.05 | 0%, F + P |
| | 22 | 0.42 | 0.14 | 0.91 | — | 0.010 | — | — | — | — | — | — | — | 0.51 | 0.12 | 22% |
| | 23 | 0.28 | 0.14 | 2.02 | — | 0.020 | — | — | — | — | — | — | — | 0.25 | — | 12% |
| | 24 | 0.38 | 0.22 | 0.80 | 0.010 | 0.020 | — | — | — | — | 0.051 | 0.0011 | — | 0.06 | 0.19 | 5% |

TABLE 1-continued

| | Test | Chemical composition (mass %; balance Fe and Impurities) | | | | | | | | | | | | | | Bainite fraction |
|---|---|---|---|---|---|---|---|---|---|---|---|---|---|---|---|---|
| | No. | C | Si | Mn | Ti | N | Nb | Mo | Cu | Ni | S | Ca | B | Cr | V | (%) |
| | 25 | 0.29 | 0.18 | 1.53 | 0.025 | 0.017 | — | 1.52 | — | — | — | — | — | — | — | 95% + M |
| | 26 | 0.36 | 0.17 | 0.85 | 0.012 | 0.018 | 0.040 | 0.95 | — | — | 0.050 | — | — | 0.05 | 0.01 | 92% + M |
| Reference | 27 | 0.46 | 0.26 | 1.44 | 0.001 | 0.010 | — | — | — | — | 0.046 | 0.0005 | — | 0.14 | — | — |

Note 1.
"—" in the Table indicates that they are less than the usual analytic accuracy for composition, that is, Ti: <0.001%, Nb: <0.001%, Mo: <0.01%, Cu: <0.01%, Ni: <0.01%, S: <0.01%, Ca: <0.0005%, B: <0.001%, Cr: <0.05%, V: <0.01%.
Note 2.
F, P and M in the column for the bainite fraction show microstructures other than bainite, meaning as follows: F: ferrite, P: pearlite, M: martensite.
Note 3.
Reference is for a conventional normalized steel.

The machinability was evaluated by puncturing a blind hole (bottomed hole) of 55 mm depth (including 15 mm depth previously punctured as a base hole) in the longitudinal direction of the sample, and defining the number of working holes when the maximum wear amount on the flank reached 0.2 mm as the drill life.

The tool used for the life evaluation is a gun drill of 6.2 mm diameter and 250 mm entire length and the material for the blade tip of P20 type super hard alloy according to JIS B 4053. The puncturing was practiced under the conditions at the number of rotation of 7200 rpm and a feed of 0.02 mm/rev and lubrication was conducted by coating a water soluble emulsion diluted to 20 times through internal oil supply at an oil pressure of 4 MPa. The base hole had 6.3 mm diameter and 15 mm depth.

The fatigue test piece was soft nitrided in an atmosphere of RX gas: ammonia gas=1:1 at 580° C. for 2 hours and then oil quenched to 100° C. Using the fatigue test piece subjected to soft-nitriding, a plane bending fatigue test was conducted at room temperature in atmospheric air. For several fatigue test pieces, the test was conducted after applying bend leveling. The bend leveling was conducted by appending a strain gauge to the neck of the test pieces and applying loads till the strain gage read as $15{,}000\times10^{-6}$ (corresponding to 1.5% bend leveling strain).

Specimens for observing the microstructure were sampled from round bars as hot forged, and photographs by an optical microscope were put to image analysis to determine the bainite fraction (area ratio). For the region to be defined as the bainite, regions where bainitic ferrite in the form of bamboo leaves were present were surrounded with continuous closed curves and it was calculated based on the area ratio of the regions relative to the entire area of the view field.

Table 2 collectively shows the fatigue strength upon the fatigue test without giving bend leveling, fatigue strength upon the fatigue test after applying 1.5% bend leveling, and the life of drill tool determined by the machinability test for each tested steel.

[Table 2]

TABLE 2

| | | Fatigue strength σ (MPa) | | Bend leveling | Drill tool life | |
|---|---|---|---|---|---|---|
| | Test No. | No. bend leveling | After 1.5% bend leveling | property (decrease of fatigue strength) Δσ (MPa) | Number of fabricated holes till 0.2 mm wear | Relative value based on steel species No. 1 as 100 |
| Present invention | 1 | 550 | 450 | 100 | 198 | 100 |
| | 2 | 560 | 460 | 100 | 225 | 114 |
| | 3 | 580 | 460 | 120 | 190 | 96 |
| | 4 | 580 | 470 | 110 | 205 | 104 |
| | 5 | 620 | 510 | 110 | 200 | 101 |
| | 6 | 630 | 520 | 110 | 212 | 107 |
| | 7 | 590 | 500 | 90 | 195 | 98 |
| | 8 | 580 | 490 | 90 | 210 | 106 |
| | 9 | 600 | 510 | 90 | 235 | 119 |
| | 10 | 580 | 480 | 100 | 384 | 194 |
| | 11 | 570 | 480 | 90 | 365 | 184 |
| | 12 | 580 | 480 | 100 | 416 | 210 |
| | 13 | 590 | 510 | 80 | 206 | 104 |
| | 14 | 650 | 550 | 100 | 189 | 95 |
| | 15 | 620 | 500 | 120 | 423 | 214 |
| | 16 | 610 | 515 | 95 | 396 | 200 |
| | 17 | 615 | 500 | 115 | 501 | 253 |
| | 18 | 570 | 460 | 110 | 250 | 126 |
| | 19 | 560 | 450 | 110 | 262 | 132 |
| | 20 | 570 | 460 | 110 | 253 | 127 |
| Comparative | 21 | 550 | * | — | 195 | 98 |
| | 22 | 610 | 400 | 210 | 168 | 85 |
| | 23 | 580 | 410 | 170 | 188 | 95 |
| | 24 | 560 | 405 | 155 | 373 | 188 |

TABLE 2-continued

| | Test No. | Fatigue strength σ (MPa) No. bend leveling | After 1.5% bend leveling | Bend leveling property (decrease of fatigue strength) Δσ (MPa) | Drill tool life Number of fabricated holes till 0.2 mm wear | Relative value based on steel species No. 1 as 100 |
|---|---|---|---|---|---|---|
| | 25 | 650 | * | — | 154 | 78 |
| | 26 | 640 | * | — | 172 | 87 |
| Reference | 27 | 550 | 425 | 125 | 203 | 103 |

note 1.

* Fractured during 1.5% bend leveling note 2.

Reference is for a conventional normalized steel

The bend leveling property shown in Table 2 is defined as the reduction (Δσ) of the fatigue strength when bend leveling is applied. The bend leveling property is evaluated to be more excellent as Δσ is smaller. The machinability is indicated by a relative value based on the number of holes that can be fabricated for No. 1 steel species being assumed as 100.

As apparent from Table 2, the present invention indicated by Nos. 1 to 20 show the fatigue strength in a case without bend leveling is equivalent to or more than 550 MPa as the fatigue strength of the conventional normalized steel indicated by No. 27, and showed only the reduction of the fatigue strength of 100 to 120 MPa which is equivalent to that of the conventional normalized steel even after applying 1.5% bend leveling.

On the other hand, while the steel type of the comparative shown by Nos. 21 to 26 also include those showing the fatigue strength equivalent to or higher than that of the steel type for the present invention in a case of not applying bend leveling property, they underwent fracture during bend leveling or show reduction of the fatigue strength of 150 MPa or more by the bend leveling and the bend leveling property is apparently inferior to that of the present invention. For example, since the steel type of the chemical composition shown by No. 21 is usually used after normalization, it formed coarse microstructure of "ferrite+pearlite" when the normalization was omitted and, accordingly, underwent brittle fracture during bend leveling.

In the steel type shown by No. 25, since the amount of Mo was excessive, then martensite was induced and it was also fractured in a brittle manner during bend leveling. In the steel type shown by No. 26 while the chemical compositions satisfied the range of the present invention, since the cooling rate was high and the martensite was present in admixture, bend leveling could not be applied. While the steel types shown by Nos. 22 to 24 showed high fatigue strength without bend leveling because of the effect of precipitation hardening caused by Cr and/or V, fatigue strength after bend leveling stayed lower. It is assumed that cracks tended to be induced in the surface layer during the bend leveling and these cracks act to trigger the fatigue fracture to result in the reduction in the fatigue strength.

As observed in Nos. 4 to 6 and Nos. 14 to 17 of the present invention, when Nb and Mo are added to the basic composition defined in the present invention, the fatigue strength after bend leveling is increased outstandingly. Further, when Ca or S is added to the basic composition of the steel according to the present invention, the machinability is improved further and the steel is more suitable as materials for parts such as crankshafts to be manufactured by way of a machining process.

Figure 1:
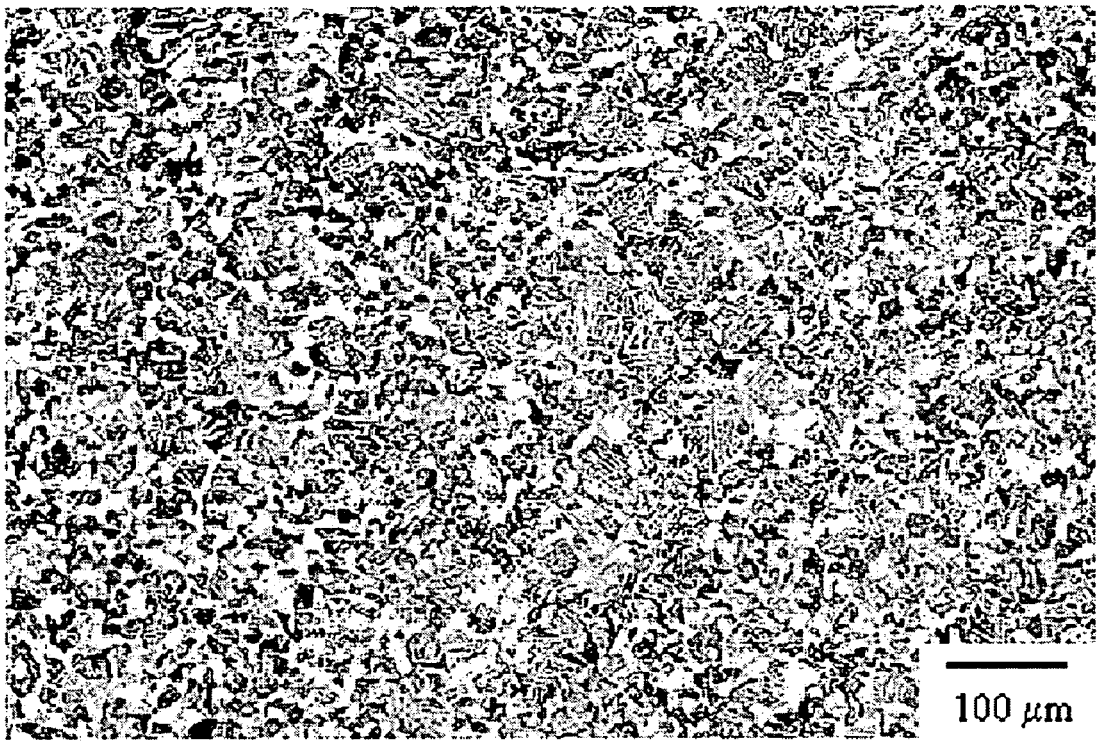
FIG. 1 is a photograph of typical mixed microstructure of "bainite+ferrite+pearlite" in the steel according to the present invention.
Figure 2:
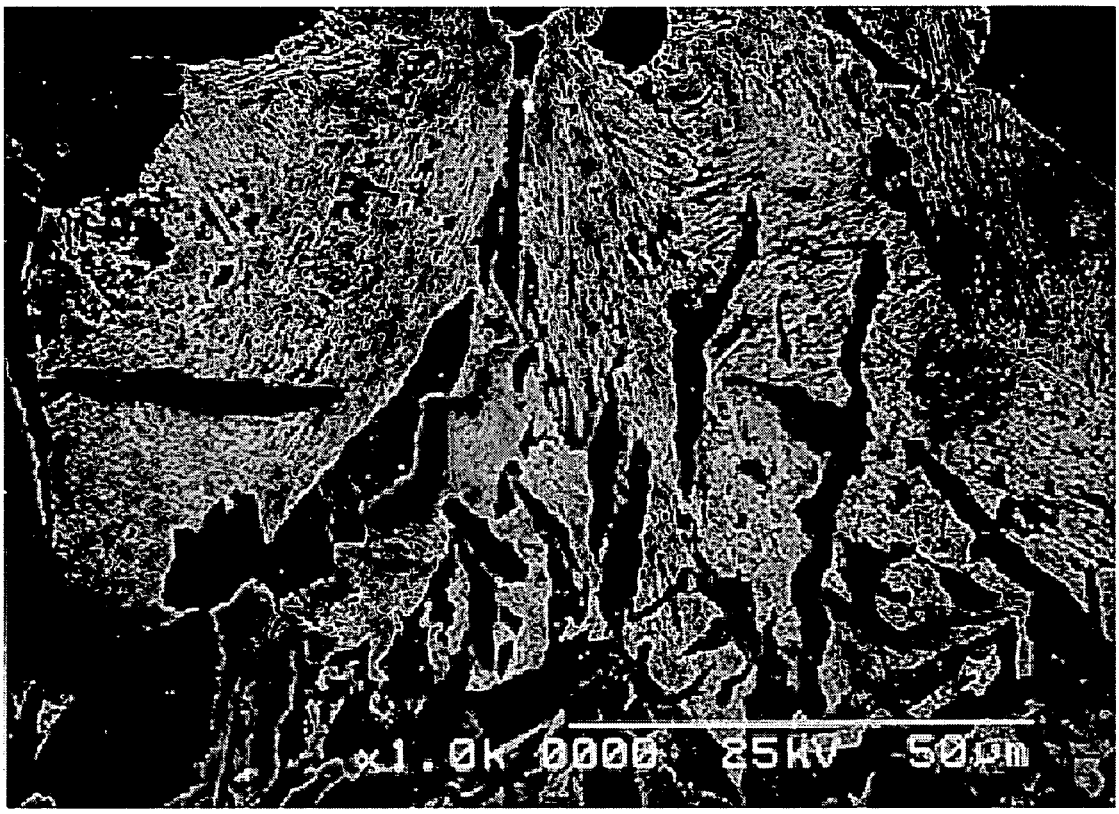
FIG. 2 is an SEM photograph of former austenite grains in which bainitic ferrite is dispersed.

The invention claimed is:

1. A non-heat treated steel for soft-nitriding characterized by consisting essentially of, by mass %, C: 0.30 to 0.45%, Si: 0.1 to 0.50%, Mn: 0.6 to 1.0%, Ti: 0.005 to 0.1%, Mo: 0.01 to 1.0%, N: 0.015 to 0.030%, and the balance Fe and impurities, wherein the content of Cr is up to 0.15% and the content of V is up to 0.02%, and also characterized by having a mixed microstructure of bainite and ferrite whose bainite fraction is 5 to 90% a or having a mixed microstructure of bainite, ferrite and pearlite whose bainite fraction is 5 to 90%.

2. A non-heat treated steel for soft-nitriding characterized by consisting essentially of, by mass %, C: 0.30 to 0.45%, Si: 0.1 to 0.5%, Mn: 0.6 to 1.0%, Ti: 0.005 to 0.1%, Mo: 0.01 to 1.0%, N: 0.015 to 0.030%, at least one element selected from Nb: 0.003 to 0.1%, Cu: 0.01 to 1.0%, Ni: 0.01 to 1.0% and B: 0.001 to 0.005%, and the balance Fe and impurities, wherein the content of Cr is up to 0.15% and the content of V is up to 0.02%, and also characterized by having a mixed microstructure of bainite and ferrite whose bainite fraction is 5 to 90% or having a mixed microstructure of bainite, ferrite and pearlite whose bainite fraction is 5 to 90%.

3. A non-heat treated steel for soft-nitriding characterized by consisting essentially of, by mass % C: 0.30 to 0.45%, Si: 0.1 to 0.5%, Mn: 0.6 to 1.0%, Ti: 0.005 to 0.1%, Mo: 0.01 to 1.0%, N: 0.015 to 0.030%, at least one element selected from S: 0.01 to 0.1% and Ca: 0.0001 to 0.005%, and the balance Fe and impurities, wherein the content of Cr is up to 0.15% and the content of V is up to 0.02%, and also characterized by having a mixed microstructure of bainite and ferrite whose bainite fraction is 5 to 90% or having a mixed microstructure of bainite, ferrite and pearlite whose bainite fraction is 5 to 90%.

4. A non-heat treated steel for soft-nitriding characterized by consisting essentially of, by mass %, C: 0.30 to 0.45%, Si: 0.1 to 0.5%, Mn: 0.6 to 1.0%, Ti: 0.005 to 0.1%, Mo: 0.01 to 1.0%, N: 0.015 to 0.030%, at least one element selected from Nb: 0.003 to 0.1%, Cu: 0.01 to 1.0%, Ni: 0.01 to 1.0% and B: 0.001 to 0.005%, at least one element selected from S: 0.01 to 0.1% and Ca: 0.0001 to 0.005%, and the balance Fe and impurities, wherein the content of Cr is up to 0.15% and the content of V is up to 0.02%, and also characterized by having a mixed microstructure of bainite and ferrite whose bainite fraction is 5 to 90% or having a mixed microstructure of bainite, ferrite and pearlite whose bainite fraction is 5 to 90%.

* * * * *